United States Patent [19]

Miller

[11] Patent Number: 4,988,911

[45] Date of Patent: Jan. 29, 1991

[54] LAMP WITH IMPROVED PHOTOMETRIC DISTRIBUTION

[76] Inventor: Jack V. Miller, 700 N. Auburn Ave., Sierra Madre, Calif. 91024

[21] Appl. No.: 270,348

[22] Filed: Oct. 17, 1988

[51] Int. Cl.[5] ..... H01J 5/16

[52] U.S. Cl. ..... 313/113

[58] Field of Search ..... 313/113; 362/255 (U.S. only), 296 (U.S. only)

[56] References Cited

U.S. PATENT DOCUMENTS

| | | | |
|---|---|---|---|
| Re. 30,832 | 12/1981 | La Giusa | 313/113 |
| 2,510,421 | 6/1950 | Rygard et al. | 313/113 X |
| 4,506,185 | 3/1985 | Giller et al. | 313/113 |
| 4,777,400 | 10/1988 | Roelevink | 313/113 X |

FOREIGN PATENT DOCUMENTS

| | | | |
|---|---|---|---|
| 2831622 | 8/1979 | Fed. Rep. of Germany | 313/113 |

*Primary Examiner*—Palmer C. DeMeo

[57] ABSTRACT

A light bulb is provided has a lamp base electrically connecting a radiant light source and supporting the light source on a central axis. An envelope is supported from the base, comprising a generally tubular transmissive portion adjacent to the base and a generally reflective portion contiguous with the transmissive portion and completing enclosure of the light source. The reflective portion is in the form of a concave curve of revolution having a first focus at the light source and configured to direct the light from the source through the transmissive portion of the envelope at approximately a 45° angle from the central axis, and wherein the 45° angle is rotated to form a depending cone of light. A preferred embodiment has an envelope including a partially transmissive reflector and a tubular window as an optically transmissive light diffuser.

12 Claims, 2 Drawing Sheets

LAMP WITH IMPROVED PHOTOMETRIC DISTRIBUTION

BACKGROUND OF THE INVENTION

For many years the commonly used light bulb has consisted of little more than a clear or diffusing glass globe surrounding a compact light source. Reflector lamps have been provided with on-axis spherical, paraboloidal or elipsoidal reflectors to produce various beam widths. Control of the direct horizontal disability glare in lighting fixtures is commonly specified as a requirement in terms of VCP (Visual Comfort Probability). Similarly, reflected glare from near-vertical light striking a task surface has been specified in commercial lighting fixtures in terms of ESI (Equivalent Sphere Illumination). Both VCP and ESI characteristics have been relegated to light fixture designers and are therefore simply ignored by the designers and manufacturers of light bulbs. Since the ordinary incandescent light bulb by far the most common light source in residential lighting, there is little or no control over the photometric properties of the lighting in virtually every home. A typical example is the ordinary table lamp, in which a light bulb with spherical light destribution is placed within a shade that limits horizontal brightness and diffusely reflects some light downwards. If the shade has high transmissivity and efficiency the horizontal brightness is excessive, providing VCP so visually disabling that it would violate lighting standards for offices or schools. If the shade is has low transmissivity the lamp is a very inefficient room light, and the small circle of light near the base creates reflected glare. In this case the inefficiency and reflected glare would be unacceptable for business or schools, but is the state of the art in nearly every home.

The purpose of the present invention is to provide a highly efficient light bulb that will profuce precisely controlled light distribution, with low horizontal brightness for high Visual Comfort Probability and low vertical reflected glare for improved Equivalent Sphere Illumination. A purpose of one preferred embodyment is to substantially remove the infra-red energy from the reflected beam by allowing it to pass through the reflector and thereby permit a cooler illuminated area.

SUMMARY OF THE INVENTION

A light bulb according to the invention comprises an enclosing transparent envelope disposed about a radiant light source, such as an incandescent filament or a gas discharge tube, and supported spaced from and on the centerline of a base, such as a screw base, bi-pin base or bayonet base, which includes a means for connection of the light source to external power. The envelope has a transmissive portion and generally reflective portion including the plane of the light source normal to the centerline of the base. The reflective portion of the envelope is a reflector in the form of a concave reflector of revolution im which a focus is at the light source and the light is reflected outside the envelope on an axis of approximately 45° to the base centerline, wherein the 45° axis is rotated to form a depending cone.

One preferred embodiment of the invention provides a light bulb for such portable lamp applications as table lamps and floor lamps, in which a filament is axially spaced in an upward direction from a screw base and is at the first focus of a reflector comprising an elipse of revolution. The reflector is generally the enclosure of the distal (zenith) end of the bulb, has its major eliptical axis passing through the filament and inscribing approximately a 45° half-angle cone in the downward proximal (nadir) direction towards the base, with a second focus inscribing a circle comprising the intersection of the depending cone with a horizontal plane outside the bulb. The reflector limits horizontal brightness by intercepting and substantially reflecting rays radiating from the source in the distal direction, and extends downward past the horizontal plane of the light source to approximately a 60° half-angle from nadir.

Another preferred embodiment of the invention provides a a light bulb for such portable lamp applications as table lamps and floor lamps, in which a filament is axially spaced in an upward direction from a screw base and is at the focus of a reflector comprising a parabola of revolution. The reflector is generally the enclosure of the distal end of the bulb, has its reflecion axis passing through the filament and inscribing approximately a 45° half-angle cone in the downward proximal (nadir) direction towards the base. The reflector limits horizontal brightness by intercepting and substantially reflecting rays radiating from the source in the distal (zenith) direction and extending downward past the horizontal plane of the light source to approximately a 60° half-angle from nadir.

DETAILED DESCRIPTION OF THE DRAWINGS

Figure 1:
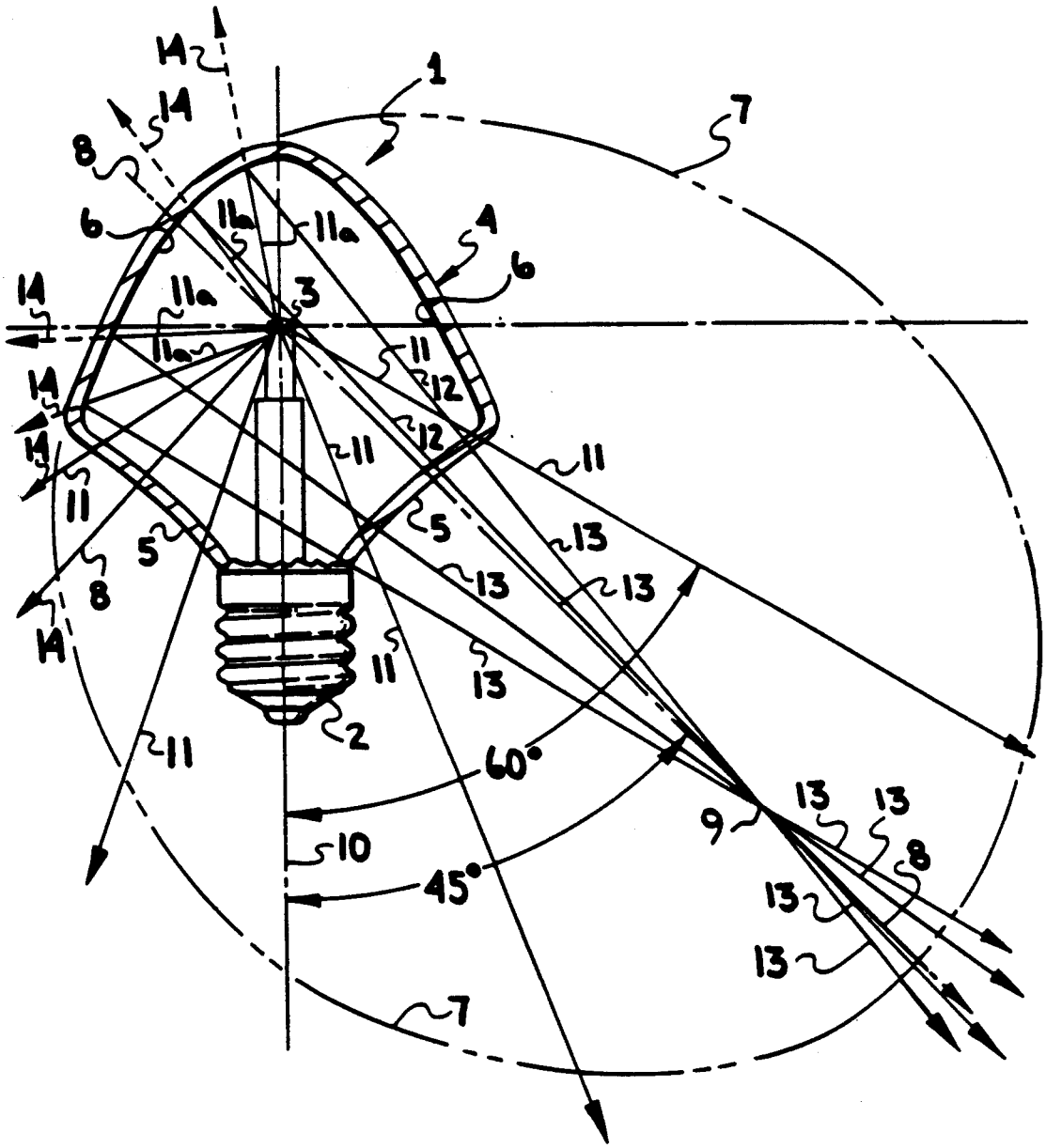
FIG. 1 is an elevation cross-sectional view of a preferred embodiment of a light bulb according to the present invention, having a reflector in the form of an elipse of revolution.

In FIG. 1 a light bulb 1 of a preferred embodiment is shown having a depending base 2 supporting and connecting a radiant light source 3, such as filament shown, to an external power source. A glass envelope 4 encloses light source 3 and has a generally transmisive window 5, and a substantially reflective portion comprising a reflector 6 capable of completely or partially reflecting incident light from source 3. A preferred embodiment of reflector 6 is in the form of a mirror film or a commonly available dichroic coating on glass envelope 4, whereby reflector 6 is substantially reflective at wavelengths shorter than 650 nanometers, and substantially transmissive at wavelengths longer than 650 nanometers. Reflector 6 is in the form of a portion of an elipsoid of revolution in which an elipse 7 has a major axis 8 passing through a first focal point at source 3 and a second focal poing 9 revolved at approximately a 45° half-angle cone about the nadir centerline 10 of base 2.

In operation there are three sources of illumination from the bulb. First, direct rays 11 are radiated from light source 3 and transmitted directly through window 5 are distributed in a generally constant brightness cone of light distributed around nadir, following the inverse square law, and extending upwards to the optical cutoff angle of approximately 60° from nadir by reflector 6. Second, direct rays 11*a* striking reflector 6 become reflected rays 12 from reflector 6 also are transmitted through window 5 through focal point 9 to be destributed generally in the direction of major axis 8 of elipse 7 in a beam pattern having a peak intensity pattern in the form of a depending cone with a half angle of approximately 45° from nadir. Third, some of the direct rays 11*a* from source 3 pass through reflector 6 and emerge from the bulb as filtered direct rays 14 of diminished intensity.

Figure 2:
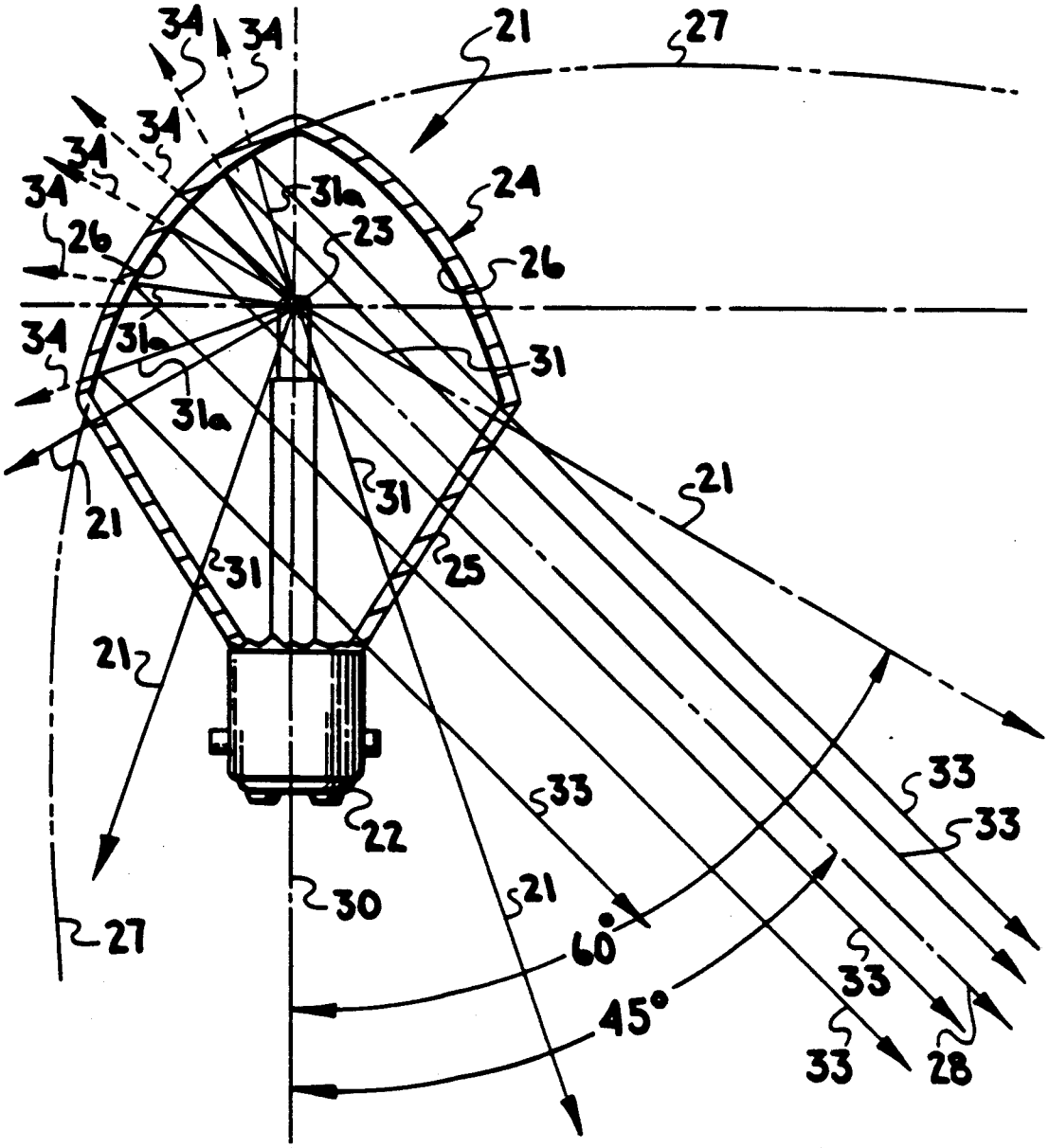
FIG. 2 is an elevation cross-sectional view of a second preferred embodiment of a light bulb according to the present invention, having a reflector in the form of a parabola of revolution.

In FIG. 2 light bulb 21 according to a second preferred embodiment of the present invention is shown having a depending base 22, illustrated as a bayonet base but equally functional as a screw base of a bi-pin base, supporting and connecting a radiant light source 23, such as filament shown, to an external power source. A glass envelope 24 encloses light source 23 and has a generally transmisive window 25 in the shape of a truncated cone, and a substantially reflective portion comprising a reflector 26 capable of completely or partially reflecting incident light from source 23. Reflector 26 is in the form of a portion of a parabola of revolution in which a parabola 27 has a major axis 28 passing through a focal point at source 23 and generally collimating rays 33 parallel to the parabolic axis 28, which is revolved at approximately a 45° half-angle cone about nadir centerline 30.

In operation there are three sources of illumination from the bulb. First, direct rays 31 are radiated from light source 23 and transmitted directly though window 25 are distributed in a generally constant brightness cone of light dirtributed around nadir, following the inverse square law, and extending upwards to the optical cut-off angle of approximately 60° from nadir by reflector 26. Second, direct rays 31*a* striking reflector 26 become reflected rays 33 from reflector 26 also are transmitted through window 25 to be distributed generally in the direction of major axis 28 of parabola 26 in a beam pattern having a peak intensity in the form of a depending cone with a half angle of approximately 45° from nadir. Third, some of the direct rays 31*a* from source 23 pass through reflector 26 and emerge from the bulb as filtered direct rays 34 of longer diminished intensity.

The resulting light bulb exhibits excellent Visual Comfort Probability, having very low horizontal brightness in both bare bulb installations, such as chandeliers; and also in fixtures having relatively transparent or translucent diffusing shades. The bulb according to the invention also exhibits very high Equivalent Sphere Illumination, having low energy in the regions near nadir where reflected glare is not desireable.

The present invention shows a preferred embodiment in the common screw base configuration for medium 110 v sockets and a bayonet base common for 12 v systems. Other standard bases, flanged, prefocussed, bi-pin and wire terminal bases are obvious applications for the bulb within the scope of the invention.

I claim:

1. A lamp comprising:

an envelope having a proximal end and a distal end, said envelope having a central axis passing through said proximal and distal ends;

a base having a central axis coinciding with said central axis of said envelope, said base supporting and electrically connecting a radiant light source to an external power supply, said base having a proximal end and a distal end, said distal end of said base being attached to the proximal end of said envelope; said envelope having a light transmissive window at its proximal end, said window having a proximal end and a distal end, said window being disposed about said central axis and extending away from the distal end said base;

a reflector formed on a surface of said envelope, opposite to said window, and having a proximal end and a distal end, said reflector having its proximal end adjacent to the distal end of said window and disposed about said central axis, reflector being in the form of an internally concave figure of revolution having a focus at said radiant light source and so configured as to direct the light from the source through said window at approximately a 45° angle from the proximal end of the central axis.

2. A lamp according to claim 1 in which the reflector enclosing the light source extends in the proximal direction past the horizontal plane of the source to approximately a 60° half angle measured from the proximal end of the central axis.

3. A lamp according to claim 1 in which the light source is an incandescent filament.

4. A lamp according to claim 1 in which the reflector is partially reflective.

5. A lamp according to claim 1 in which the reflector is dichroic, being generally reflective to visible light having a wavelength shorter than 650 nanometers, and is generally transmissive to infra-red light having a wavelength longer than 650 nanometers.

6. A lamp according to claim 1 in which the base is a screw-shell base.

7. A lamp according to claim 1 in which the base is a bayonet base.

8. A lamp according to claim 1 in which the base is a bi-pin base.

9. A according to claim 1 in which the reflector is a ellipse of revolution having a first focus at the light source and a second focus on approximately a 45° angle from the proximal end of the central axis.

10. A lamp according to claim 1 in which the reflector is an off-axis parabola of revolution having a focus at the light source and a conical light distribution at approximately a 45° angle from the proximal end of the central axis.

11. A lamp according to claim 1 in which the window is a truncated cone having its small end contiguous with the base and its large end contiguous with the reflector.

12. A lamp according to claim 1 in which the window is an optically transmissive light diffuser.

* * * * *